US008010017B2

(12) United States Patent
Foster et al.

(10) Patent No.: US 8,010,017 B2
(45) **Date of Patent: *Aug. 30, 2011**

(54) FUSER ASSEMBLY INCLUDING A NIP RELEASE BIAS SPRING

(75) Inventors: Larry Steven Foster, Lexington, KY (US); Edward Lawrence Kiely, Lexington, KY (US); Jeffrey Lawrence Tonges, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 201 days.

This patent is subject to a terminal disclaimer.

(21) Appl. No.: 12/046,863

(22) Filed: Mar. 12, 2008

(65) Prior Publication Data

US 2009/0232549 A1 Sep. 17, 2009

(51) Int. Cl.
*G03G 15/16* (2006.01)
*G03G 15/20* (2006.01)

(52) U.S. Cl. ..... 399/122; 399/328; 399/329

(58) Field of Classification Search ..... 399/122, 399/124, 328, 329

See application file for complete search history.

(56) References Cited

U.S. PATENT DOCUMENTS

| | | | | |
|---|---|---|---|---|
| 4,428,660 | A * | 1/1984 | Matsumoto | 399/122 |
| 6,253,046 | B1 | 6/2001 | Horrall et al. | |
| 6,681,090 | B2 * | 1/2004 | Cornelius | 399/122 |
| 6,681,094 | B2 | 1/2004 | Horrall et al. | |
| 7,003,246 | B2 * | 2/2006 | Gogate et al. | 399/122 |
| 2005/0063743 | A1 * | 3/2005 | Cho et al. | 399/328 |
| 2006/0096084 | A1 | 5/2006 | Hamilton et al. | |

OTHER PUBLICATIONS

U.S. Appl. No. 11/668,635, filed Jan. 30, 2007, Embry et al.
U.S. Appl. No. 11/669,206, filed Jan. 31, 2007, Embry et al.

* cited by examiner

*Primary Examiner* — Sandra L Brase
(74) *Attorney, Agent, or Firm* — Stevens & Showalter

(57) ABSTRACT

A fuser assembly includes first and second fuser structures, drive apparatus and nip engagement and release apparatus. The nip engagement and release apparatus includes nip-loading structure, a bias spring for engaging the nip-loading structure, a nip release cam for engaging the bias spring, a swing arm assembly and nip release structure. The nip engagement and release apparatus is adapted to cause a fuser nip to release during a reverse operation except when performing a duplex operation.

20 Claims, 10 Drawing Sheets

FUSER ASSEMBLY INCLUDING A NIP RELEASE BIAS SPRING

This application is related to U.S. patent application Ser. No. 11/668,635, filed Jan. 30, 2007, entitled FUSER ASSEMBLY INCLUDING A NIP RELEASE MECHANISM and U.S. patent application Ser. No. 11/669,206, filed Jan. 31, 2007, entitled RETRACTION MECHANISM FOR A TONER IMAGE TRANSFER APPARATUS, both of which are hereby incorporated by reference herein.

FIELD OF THE INVENTION

The present invention relates to a fuser assembly including a nip engagement and release apparatus.

BACKGROUND OF THE INVENTION

In an electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to the media intended to receive the final permanent image. The toner image is fixed to the media by the application of heat and pressure in a fuser assembly. A fuser assembly may include a heated roll and a backup roll forming a fuser nip through which the media passes. A fuser assembly may also include a fuser belt and an opposing backup member, such as a backup roll.

Traditionally, the fuser rolls and belts comprise an outer compliant layer. These compliant layers can be deformed permanently, i.e., compression set, if left inactive and under pressure for prolonged periods of time. The deformation can lead to print defects.

SUMMARY OF THE INVENTION

In accordance with an aspect of the present invention, a fuser assembly is provided comprising first and second fuser structures, drive apparatus, and nip engagement and release apparatus. The first fuser structure comprises a heated rotatable member and a first support structure for supporting the heated rotatable member. The second fuser structure comprises a rotatable backup member positioned adjacent the heated rotatable member and second support structure for supporting the backup member. The rotatable backup member is adapted to define a nip with the heated rotatable member. The drive apparatus is associated with one of the heated rotatable member and the backup member for effecting rotation of the one member in a selected first direction or a second direction. The nip engagement and release apparatus comprises nip-loading structure, at least one spring for engaging the nip-loading structure, a swing arm assembly, and nip release structure. The swing arm assembly is adapted to pivot to a first position in response to the one member rotating in the first direction and to a second position in response to the one member rotating in the second direction and the nip release structure being positioned in a relaxed state. The nip-loading structure is adapted to apply a sufficient force to one of the first and second support structures to achieve a desired nip load in response to the one member rotating in the first direction and decreasing the force to the one support structure to decrease the load at the nip in response to the one member rotating in the second direction and the nip release structure being positioned in a relaxed state.

BRIEF DESCRIPTION OF THE DRAWINGS

The following detailed description of the preferred embodiments of the present invention can best be understood when read in conjunction with the following drawings, where like structure is indicated with like reference numerals, and in which.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
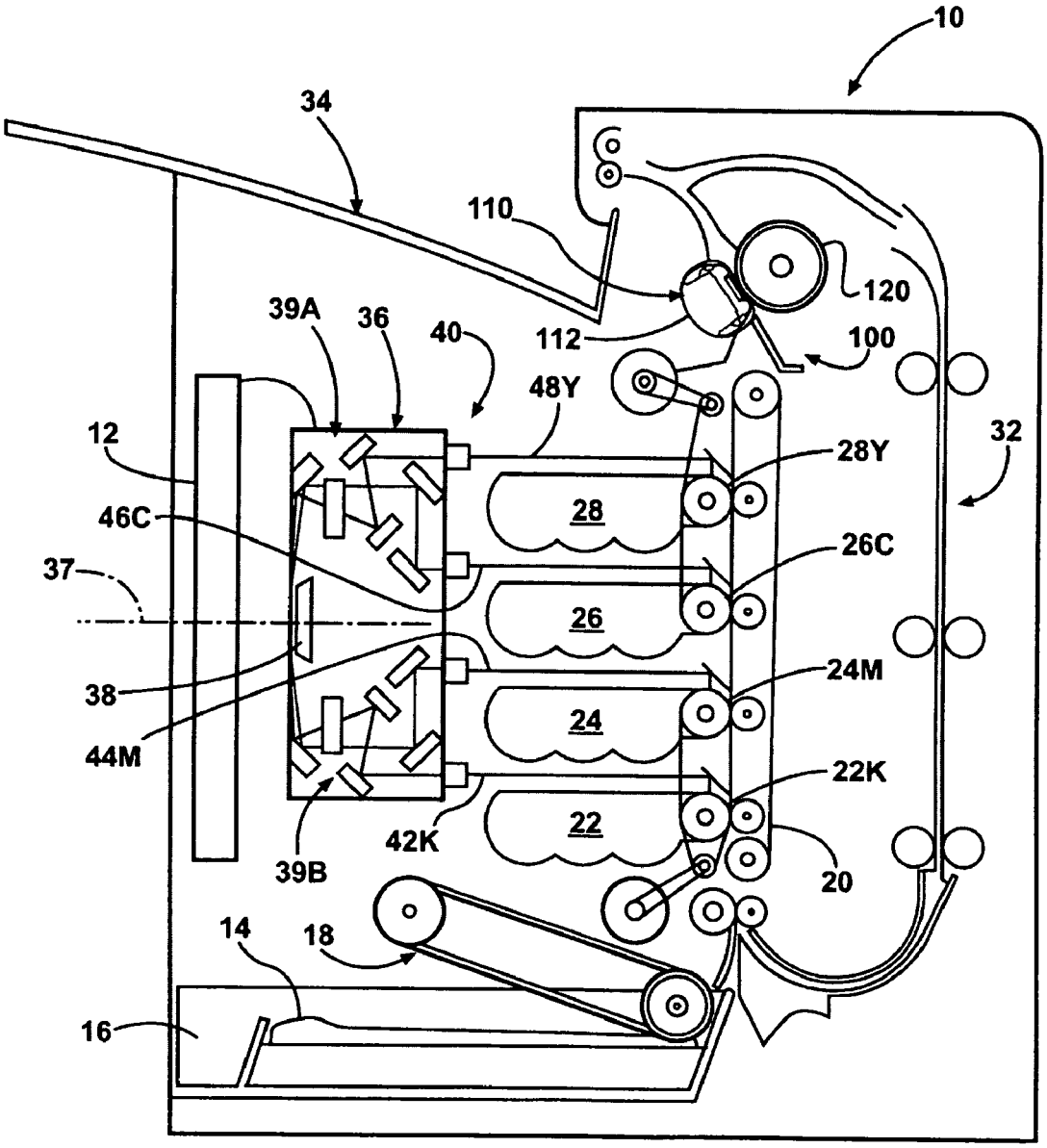
FIG. 1 is a schematic view of a printer including a fuser assembly constructed in accordance with an aspect of the present invention.

FIG. 1 depicts a representative electrophotographic image forming apparatus, such as a color laser printer, which is indicated generally by the numeral 10. An image to be printed may be electronically transmitted to a print engine controller or processor 12 by an external device (not shown) or may comprise an image stored in a memory of the processor 12. The processor 12 includes system memory, one or more processors, and other logic necessary to control the functions of electrophotographic imaging.

In performing a printing operation, the processor 12 initiates an imaging operation where a top substrate 14 of a stack of media is picked up from a media tray 16 by a pick mechanism 18 and is delivered to a media transport belt 20. The media transport belt 20 carries the substrate 14 past each of four image forming stations 22, 24, 26, 28, which apply toner to the substrate 14. The image forming station 22 includes a photoconductive drum 22K that delivers black toner to the substrate 14 in a pattern corresponding to a black image plane of the image being printed. The image forming station 24 includes a photoconductive drum 24M that delivers magenta toner to the substrate 14 in a pattern corresponding to the magenta image plane of the image being printed. The image forming station 26 includes a photoconductive drum 26C that delivers cyan toner to the substrate 14 in a pattern corresponding to the cyan image plane of the image being printed. The image forming station 28 includes a photoconductive drum 28Y that delivers yellow toner to the substrate 14 in a pattern corresponding to the yellow image plane of the image being printed. The processor 12 regulates the speed of the media transport belt 20, media pick timing and the timing of the image forming stations 22, 24, 26, 28 to effect proper registration and alignment of the different image planes to the substrate 14.

The media transport belt 20 then carries the substrate 14 with the unfused toner image superposed thereon to an image heating apparatus or fuser assembly 100, which applies heat and pressure to the substrate 14 so as to promote adhesion of the toner thereto. Upon exiting the fuser assembly 100, the substrate 14 is either fed into a duplexing path 32 for performing a duplex printing operation on a second surface of the substrate 14, or the substrate 14 is conveyed from the apparatus 10 to an output tray 34.

To effect the imaging operation, the processor 12 manipulates and converts data defining each of the KMCY image planes into separate corresponding laser pulse video signals, and the video signals are then communicated to a printhead 36. The printhead 36 may include four laser light sources (not shown) and a single polygonal mirror 38 supported for rotation about a rotational axis 37, and post-scan optical systems 39A and 39B receiving the light beams emitted from the laser light sources. Each laser of the laser light sources emits a respective laser beam 42K, 44M, 46C, 48Y, each of which is reflected off the rotating polygonal mirror 38 and is directed towards a corresponding one of the photoconductive drums 22K, 24M, 26C and 28Y by select lenses and mirrors in the post-scan optical systems 39A, 39B.

Figure 2:
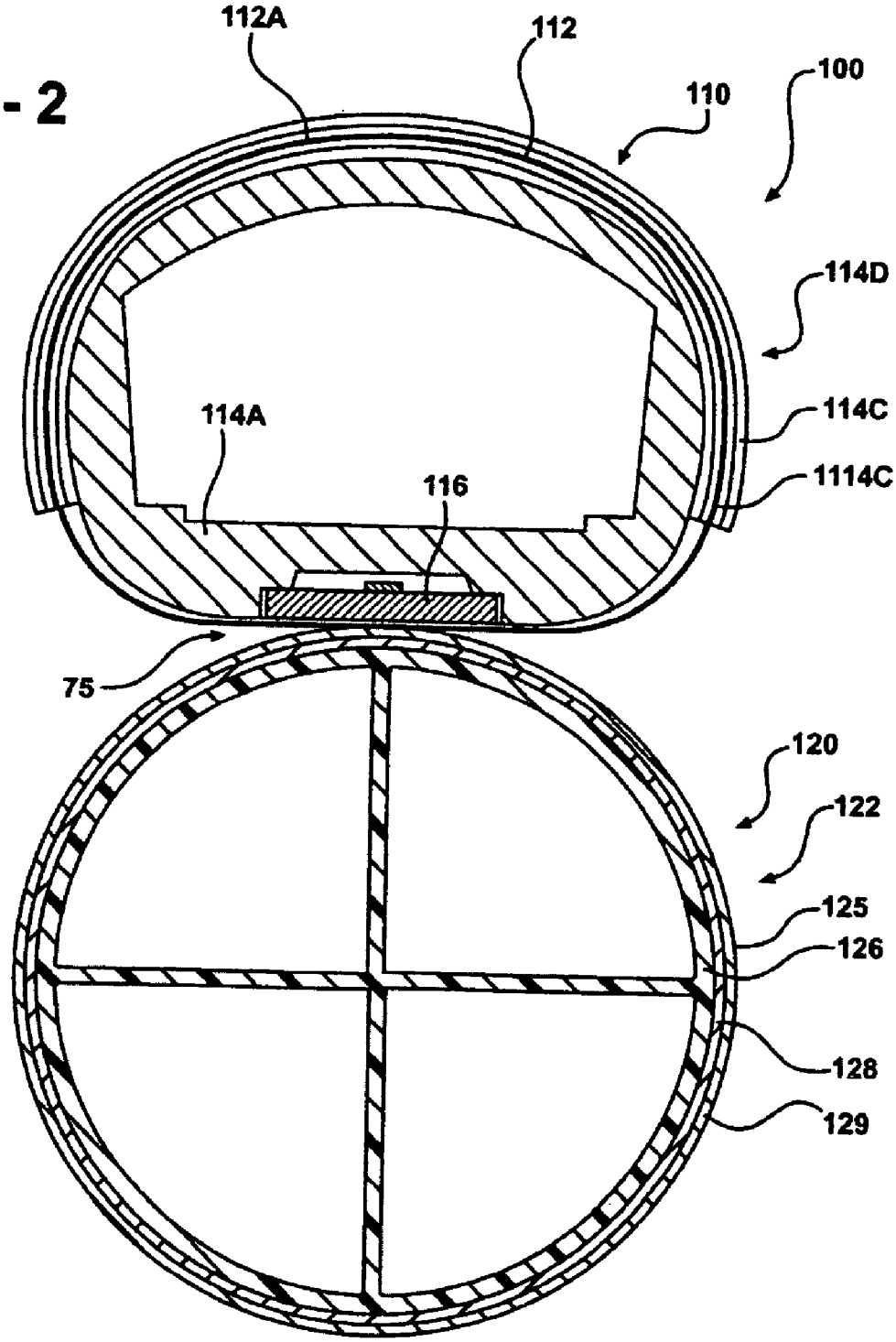
FIG. 2 is a cross sectional view of first and second fuser structures of the fuser assembly illustrated in FIG. 1.
Figure 3:
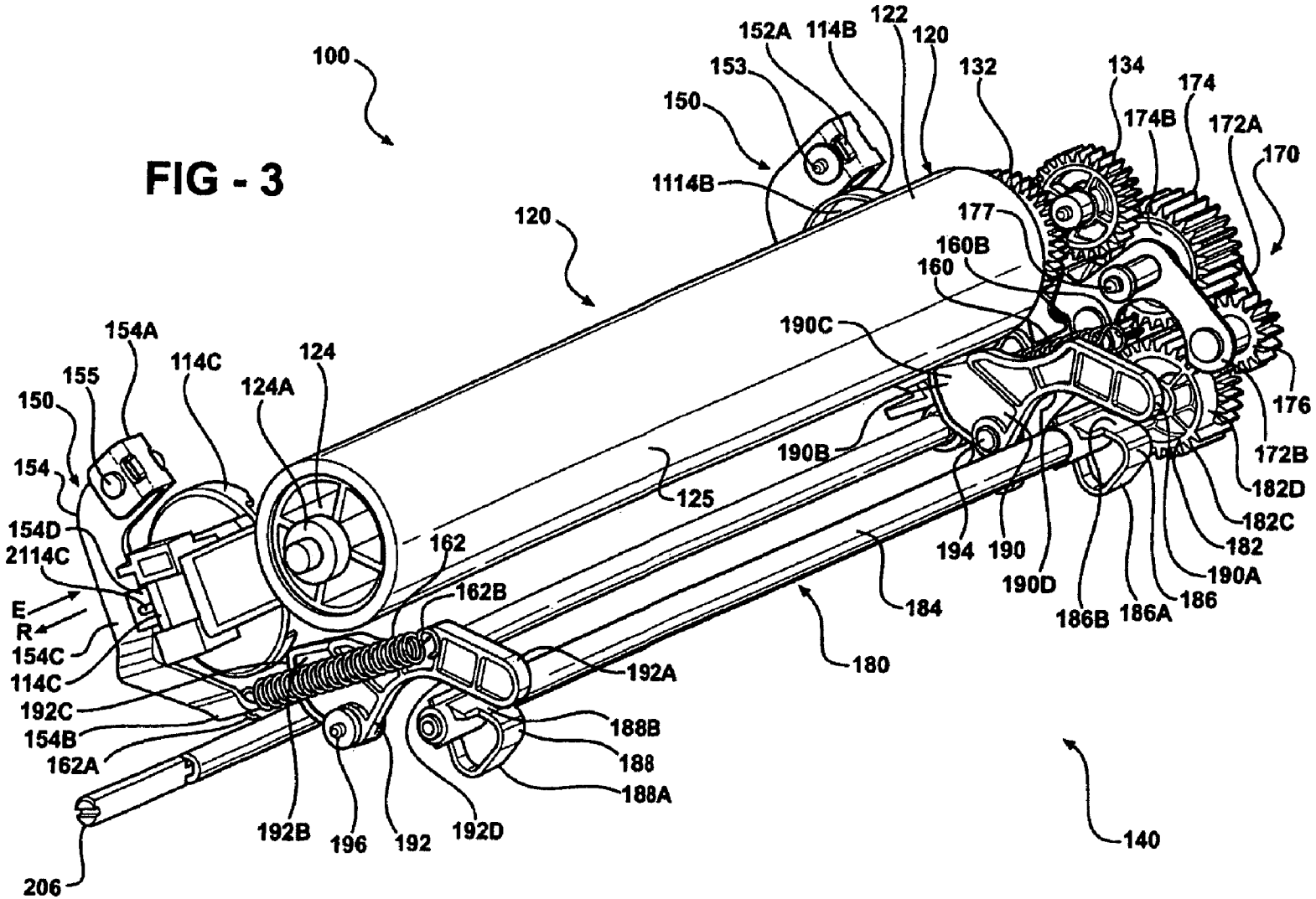
FIG. 3 is a perspective view of the fuser assembly illustrated in FIG. 1 without the main frame.
Figures 4, 4A:
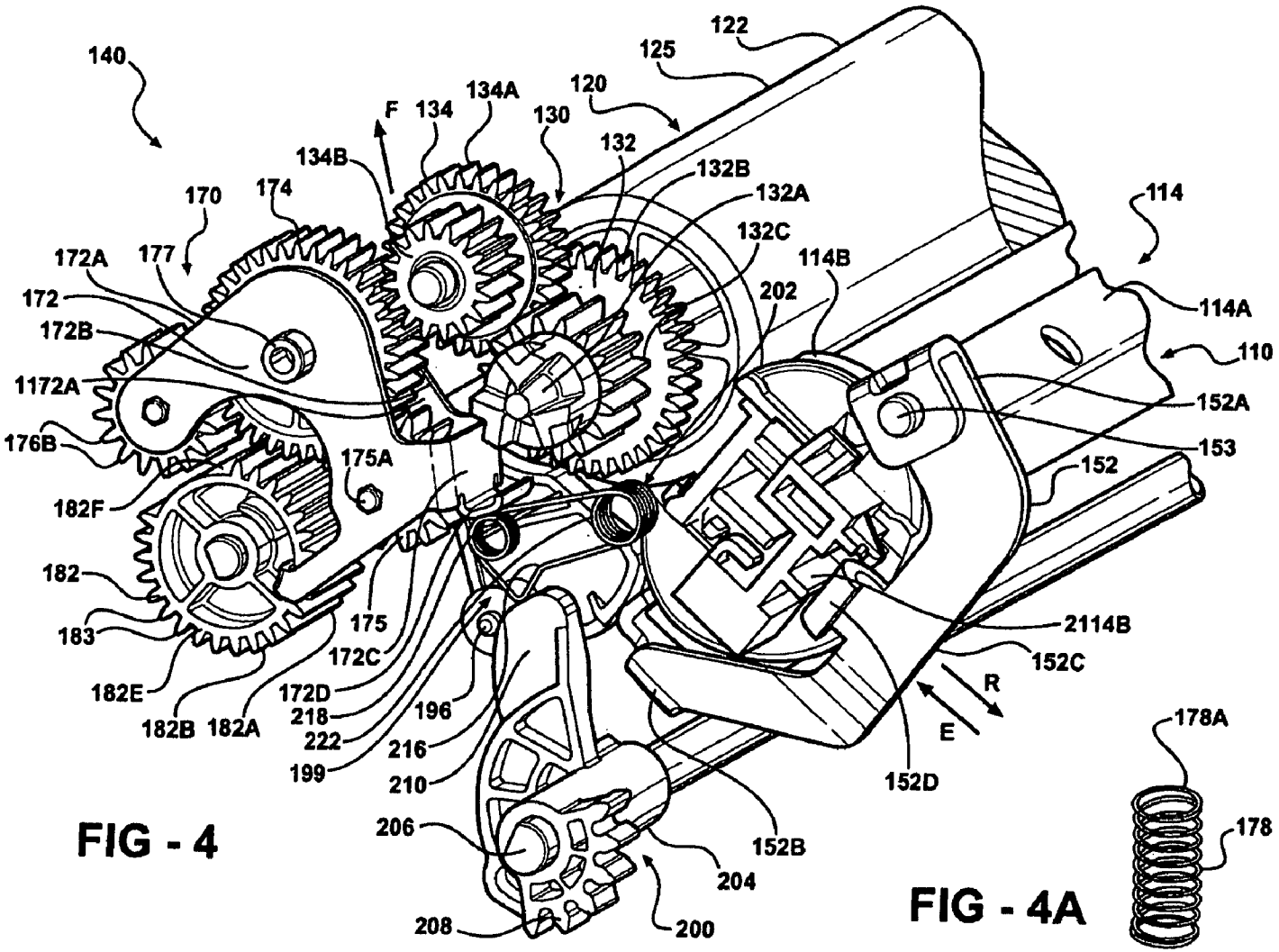
FIG. 4 is a perspective view of the swing arm assembly of the fuser assembly illustrated in FIG. 1.
FIG. 4A is a side view of a drag generating member.

The fuser assembly 100 in the illustrated embodiment comprises first and second fuser structures 110 and 120, respectively, drive apparatus 130 and nip engagement and release apparatus 140, see FIGS. 3 and 4. The first fuser structure 110 comprises a rotatable member 112; shown only in FIGS. 1 and 2; first support structure 114 for supporting the rotatable member 112; and a heater element 116, shown only in FIG. 2, for heating the rotatable member 112. The first support structure 114 is coupled to a main frame 102 of the fuser assembly 100, see FIGS. 4 and 5. The second fuser structure 120 comprises a rotatable backup member 122 positioned adjacent the heated rotatable member 112 and second support structure 124, see FIG. 3, for supporting the backup member 122. The rotatable backup member 122 defines a nip 75 with the heated rotatable member 112 for receiving a substrate 14 with a toner image thereon, see FIG. 2. The heated rotatable member 112 and the backup member 122 apply heat and pressure to the substrate 14 passing through the nip 75 to fuse the toner image to the substrate 14.

Figures 5, 5A:
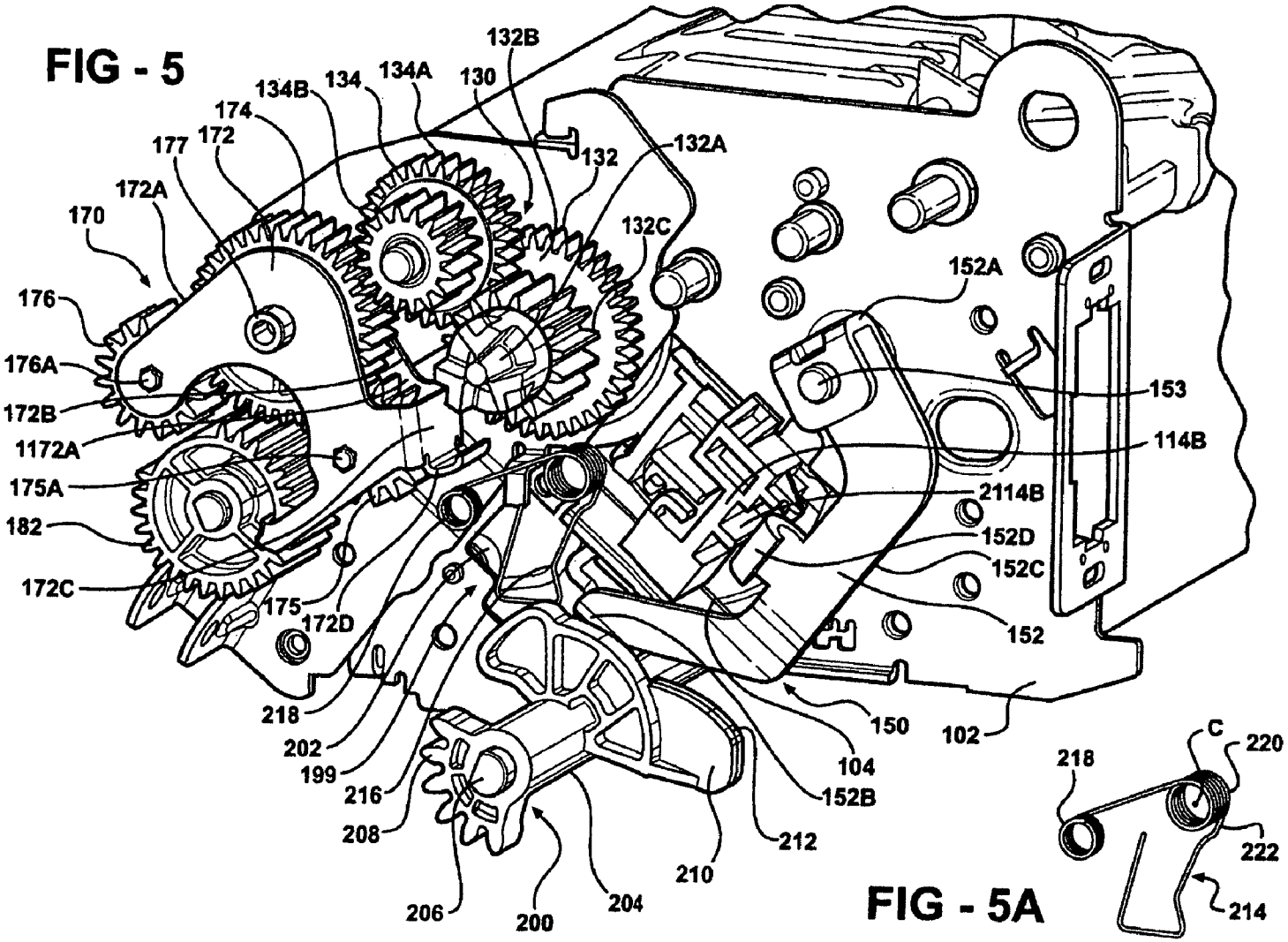
FIG. 5 is a perspective view of a portion of the fuser assembly illustrated in FIG. 1.
FIG. 5A is a side view of a bias spring.

In the illustrated embodiment, the first support structure 114 comprises a bracket 114A supporting the heater element 116 and first and second endcaps 114B and 114C for supporting the bracket 114A. Each endcap 114B, 114C is received in a corresponding one of two slots 104, only one of which is shown in FIG. 5, in the main frame 102 of the fuser assembly 100. The endcaps 114B and 114C are capable of reciprocating movement within the slots 104.

The heated rotatable member 112 comprises an endless belt 112A, see FIG. 2. The belt 112A is positioned about the heater element 116 and the bracket 114A and ends of the belt 112A are received in recesses 1114B and 1114C formed in the first and second endcaps 114B and 114C, respectively, see FIGS. 2 and 3. The belt 112A may comprise a thin film, and preferably comprises a stainless steel tube covered with an elastomeric layer, such as a silicone rubber layer. The elastomeric layer is formed on the outer surface of the stainless steel tube so as to contact substrates 14 passing between the heater element 116 and the rotatable backup member 122.

In the illustrated embodiment, the rotatable backup member 122 comprises a backup roller 125 including an inner core 126, an inner polymeric layer 128 and an outer toner release layer or sleeve 129. The inner core 126 may be formed from a polymeric material, steel, aluminum or a like material. The inner polymeric layer 128 may be formed from a silicone foam or rubber material. The outer release layer 129 may comprise a sleeve formed from PFA (polyperfluoroalkoxytetrafluoroethylene) or other fluororesin material. The outer release layer 129 may also be formed via a latex and/or PFA spray coating.

The second structure 124 for supporting the backup member 122 comprises a pair of bearings 124A, only one of which is shown in FIG. 3. The bearings 124A are coupled to the main frame 102 of the fuser assembly 100.

In the illustrated embodiment, the drive apparatus 130 comprises a drive motor (not shown) including a gearing structure (not shown) that engages a dog clutch 132A integral with a first compound gear 132, see FIG. 5. A first portion 132B of the first compound gear 132 engages an accessory gear (not shown) while the second portion 132C of the first compound gear 132 engages a first portion 134A of a second compound gear 134. A second portion 134B of the second compound gear 134 engages a first gear 174, to be described below. In the illustrated embodiment, the first compound gear 132 is coupled to the backup member 122 via a one way clutch (not shown) so as to cause the backup member 122 to rotate clockwise as seen in FIG. 3 when the first compound gear 132 is driven clockwise, i.e., a forward direction. When the first compound gear 132 is driven counter-clockwise as seen in FIG. 3, i.e., a reverse direction, the one-way clutch does not rotate the backup member 122. The drive motor is controlled by the processor 12, which controls the rotational direction and speed of the motor.

In the illustrated embodiment, the nip engagement and release apparatus 140 comprises nip-loading structure 150, first and second springs 160 and 162, a swing arm assembly 170, a cam assembly 180 and nip release structure 199.

The nip-loading structure 150 comprises, in the illustrated embodiment, first and second levers 152 and 154, see FIGS. 3, 4 and 5. The first lever 152 is pivotably coupled at a first end 152A to the main frame 102 via a pin 153. The first lever 152 further comprises a second end 152B and a U-shaped intermediate portion 152C including an extension 152D. The first lever extension 152D engages an engagement member 2114B of the first endcap 114B. The second lever 154 is pivotably coupled at a first end 154A to the main frame 102 via a pin 155. The second lever 154 further comprises a second end 154B and a U-shaped intermediate portion 154C including an extension 154D, see FIG. 3. The second lever extension 154D engages an engagement member 2114C of the second endcap 114C, see FIG. 3.

The first spring 160 comprises an extension spring having a first end 160A (not shown) engaging the first end 152B of the first lever 152 and a second end 160B engaging a first hook (not shown) provided on the main frame 102. The second spring 162 comprises an extension spring having a first end 162A engaging the first end 154B of the second lever 154 and a second end 162B engaging a second hook (not shown) provided on the main frame 102, see FIG. 3. The first and second springs 160 and 162 apply a biasing force to the first ends 152B and 154B of the first and second levers 152 and 154 urging the first and second levers 152 and 154 to rotate about the pins 153 and 155 clockwise in FIGS. 4 and 5 and counter-clockwise in FIG. 3. As a result, the first and second lever extensions 152D and 154D apply a force to the first and second engagement members 2114B and 2114C of the first and second endcaps 114B and 114C, generally in the direction indicated by the arrow E, see FIGS. 3 and 4. The spring rates of the springs 160 and 162 are preferably selected such that the forces applied by the extensions 152D and 154D onto the endcaps 114B and 114C are sufficient to achieve a desired nip load, i.e., a desired compressive load within the nip 75.

The swing arm assembly 170 comprises, in the illustrated embodiment, a frame 172 comprising first and second spaced-apart mounting plates 172A and 172B connected by an intermediate member 172C; first, second and third gears 174-176; and a drag generating member 178, see FIGS. 3, 4, 4A and 5. The intermediate member 172C further comprises a tab 172D for engaging a bias spring as will be described below. The first gear 174 is rotatably mounted between the first and second mounting plates 172A and 172B. A shaft 177 is fixed to the main frame 102 and extends through bores in the first mounting plate 172A, the first gear 174 and the second mounting plate 172B. The first and second plates 172A and 172B are further secured to one another via pins 175A and 176A passing through the second and third gears 175 and 176 and bores in the plates 172A and 172B, see FIGS. 4 and 5.

Figure 6:
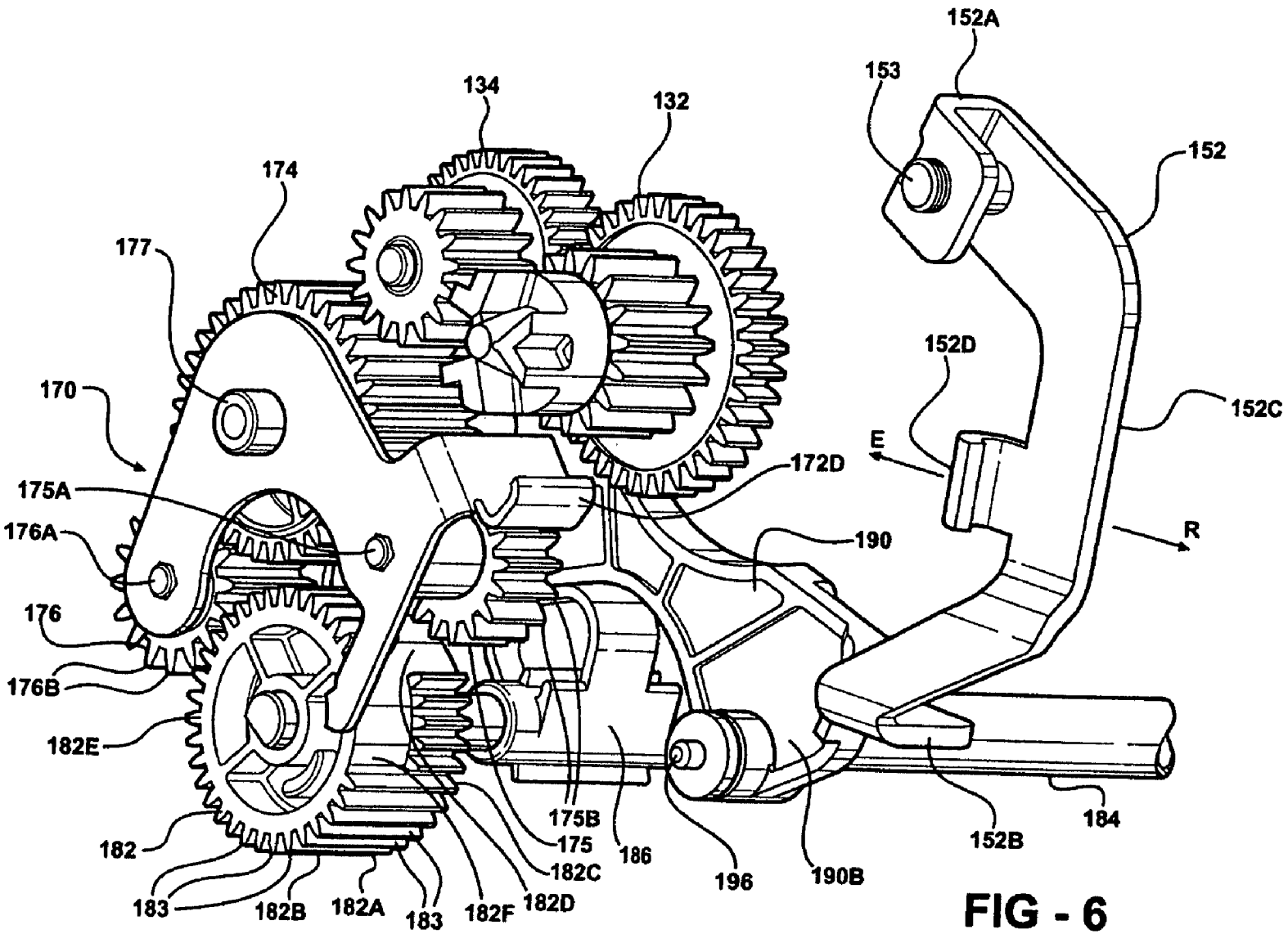
FIGS. 6-9 are perspective views showing various states of the sector gear, the first cam lever, the first lever and the swing arm assembly and with the first and second fuser structures removed.
Figure 7:
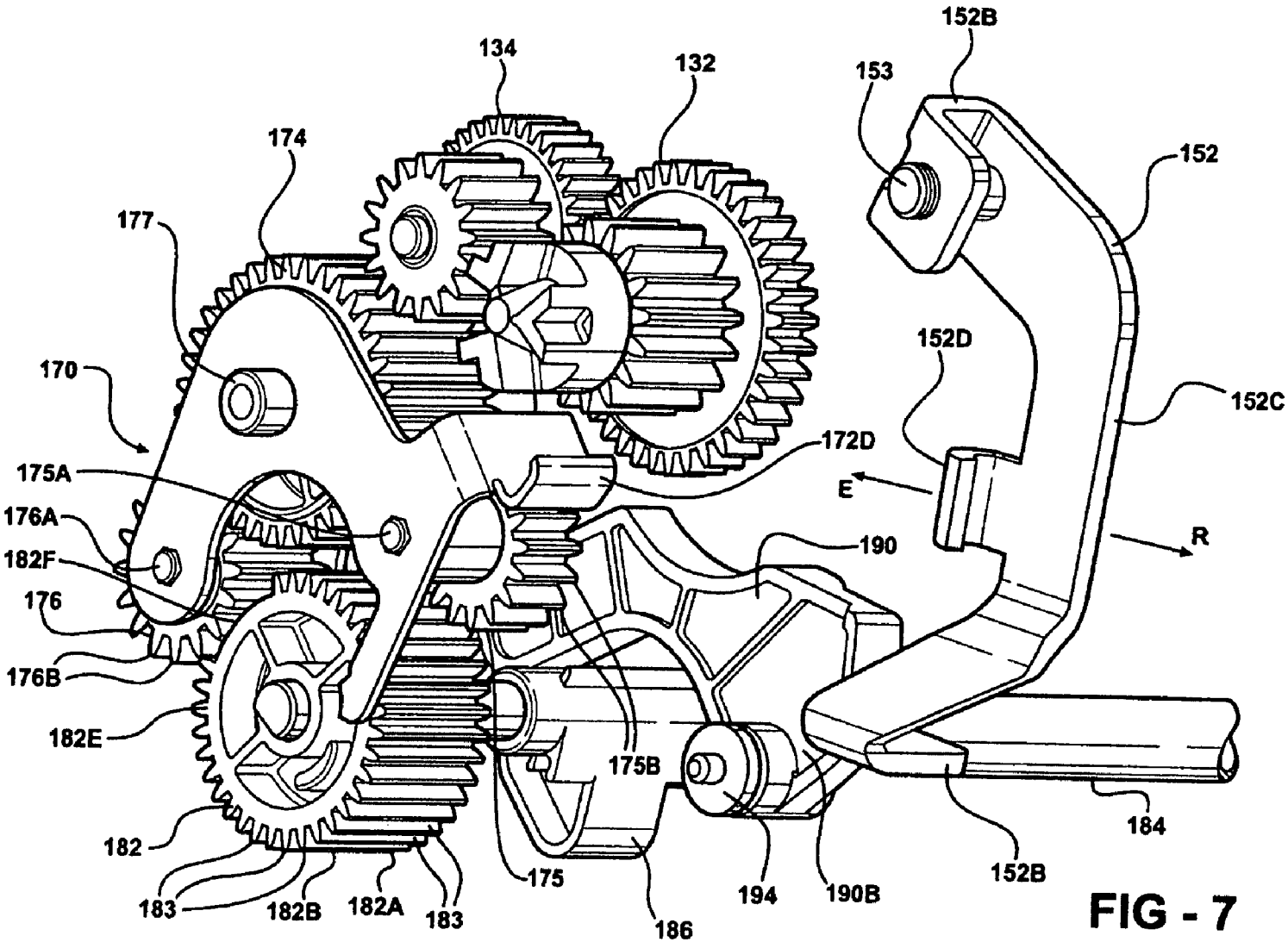
Figure 8:
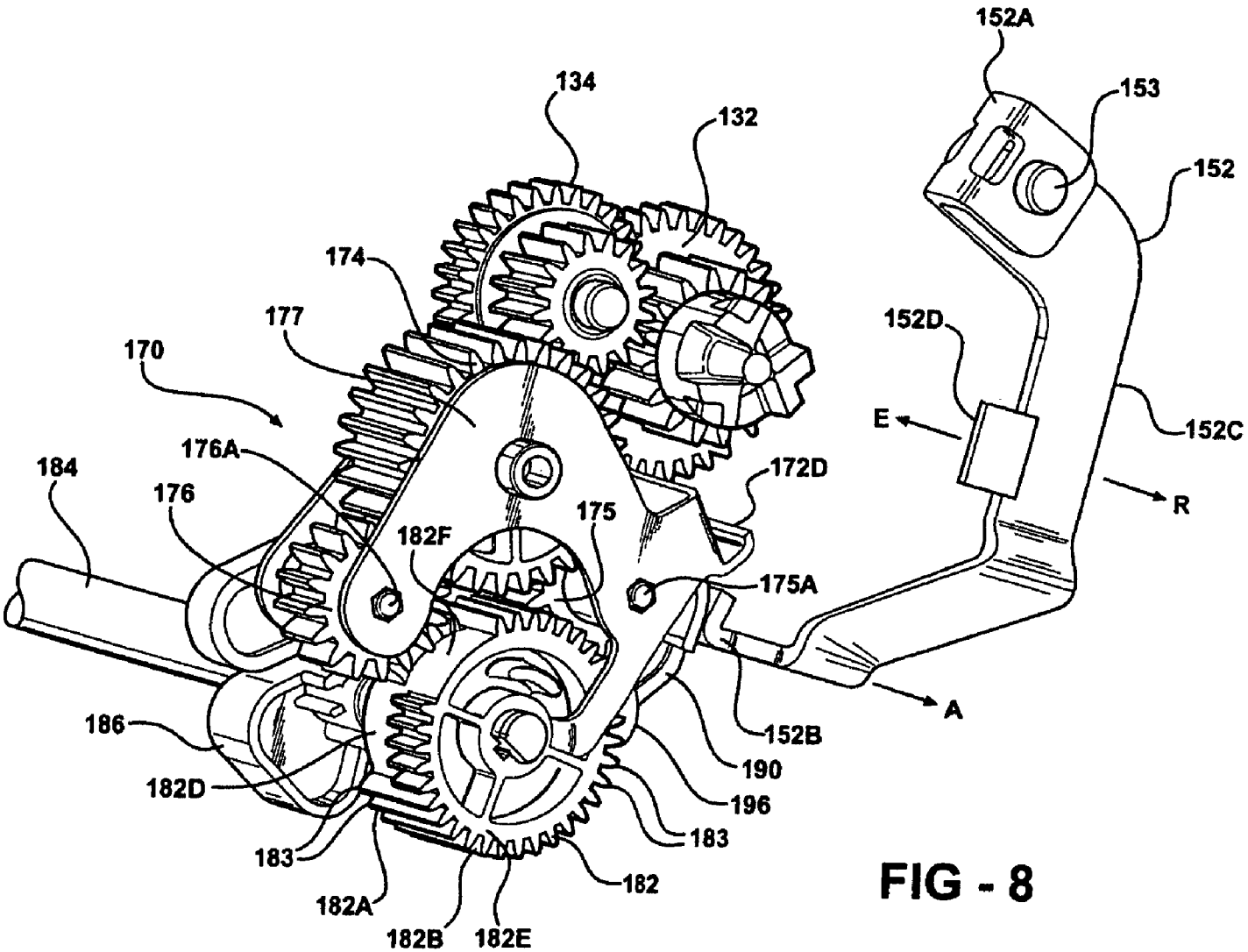
Figure 9:
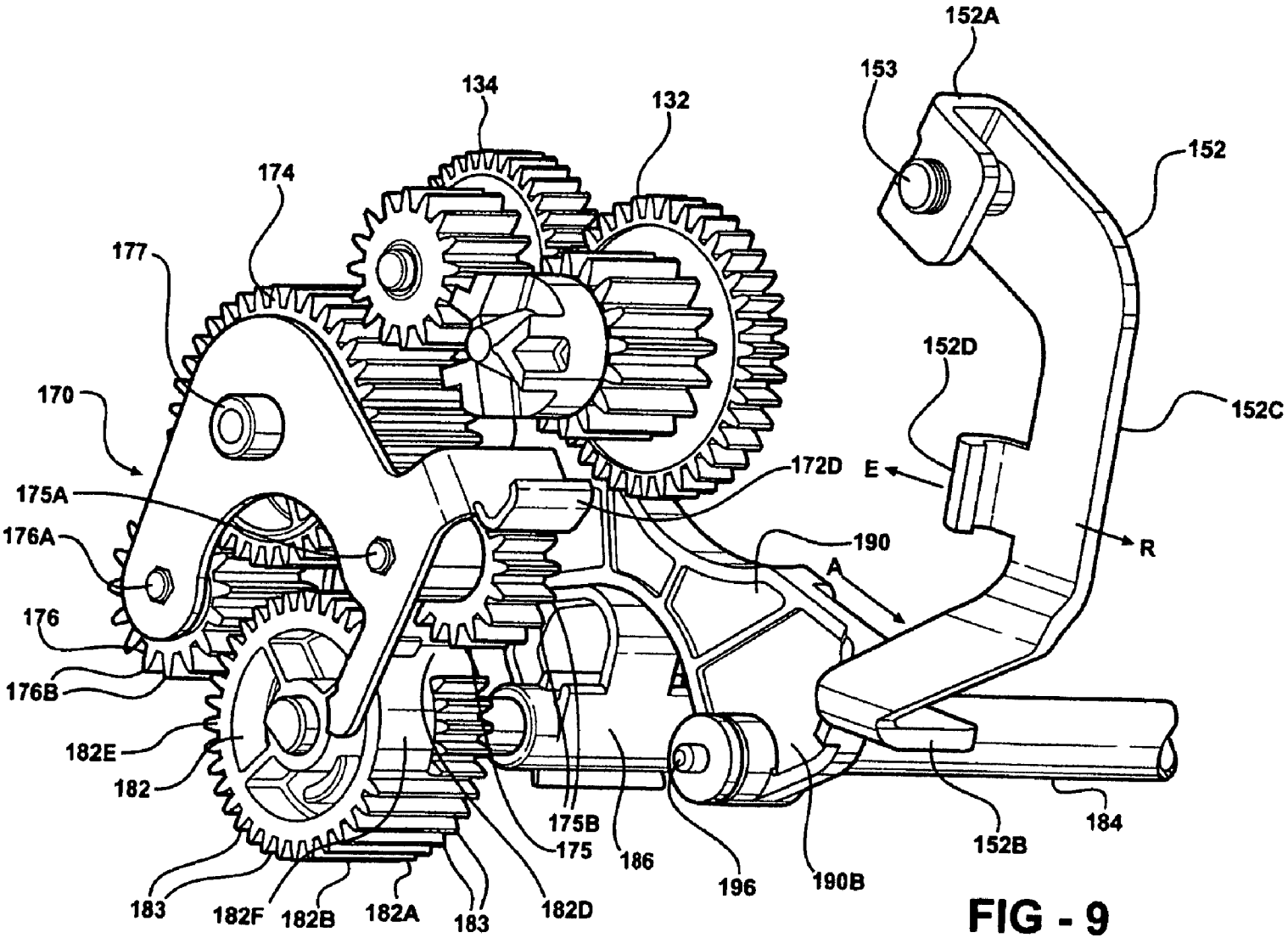

The swing arm assembly 170 pivots back and forth about an axis passing through the shaft 177 between a first end-most position, illustrated in FIGS. 6 and 7, and a second end-most position, illustrated in FIGS. 8 and 9. The first gear 174 is always in engagement with the second portion 134B of the second compound gear 134. Further, the second and third gears 175 and 176 are always in engagement with the first gear 174. Hence, the first gear 174 engages the second compound gear 134 when the swing arm assembly 170 is in its first end-most position as well as when it is in its second end-most position. Likewise, the second and third gears 175 and 176 engage the first gear 174 when the swing arm assembly 170 is in its first end-most position as well as when it is in its second end-most position. The swing arm assembly 170 moves through an angle of about 6.5 degrees when moving from its first end-most position to its second end-most position and vice versa.

In the illustrated embodiment, the drag generating member 178 comprises a helical spring 178A, shown only in FIG. 4A. The spring 178A is placed about the shaft 177 of the first gear 174 and positioned between an inner wall 1172A, see FIGS. 4 and 5, of the second mounting plate 172B and a first side 174B, see FIGS. 3 and 6A, of the first gear 174. The spring 178A transfers a force via friction from the first gear 174 to the first and second mounting plates 172A and 172B in response to rotation of the first gear 174 by the second compound gear 134. The drag generating member 178 may comprise an element other than the helical spring 178A, such as a spring washer or a protrusion (not shown) extending out from the inner wall 1172A of the second mounting plate 172B.

In first and second scenarios, the force applied by the first gear 174 to the first and second mounting plates 172A and 172B via the drag generating member 178 in response to rotation of the first gear 174 may cause the first and second plates 172A and 172B to pivot. In the first scenario, when the swing arm assembly 170 is in its first end-most position, as shown in FIG. 7, and the second compound gear 134 rotates counter-clockwise, as viewed in FIG. 4, the first gear 174 is caused to rotate clockwise causing the spring 178A to frictionally engage the inner wall 1172A of the second mounting plate 172B and generate a force capable of moving the first and second plates 172A and 172B clockwise. If the nip release structure 199 is oriented as illustrated in FIG. 5, the first and second plates 172A and 172B rotate clockwise until the second gear 175 engages an inner portion 182A of a sector gear 182 such that the swing arm assembly 170 is located in its second end-most position, see FIG. 8. Once the swing arm assembly 170 is located in its second end-most position, the spring 178A allows any further clockwise rotation of the first gear 174 to occur relative to the plates 172A and 172B.

In the second scenario, when the swing arm assembly 170 is in its second end-most position, as shown in FIG. 9, and the second compound gear 134 rotates clockwise, as seen in FIG. 4, the first gear 174 is caused to rotate counter-clockwise causing the spring 178A to frictionally engage the inner wall 1172A of the second mounting plate 172B and generate a force so as to move the first and second plates 172A and 172B counter-clockwise. The first and second plates 172A and 172B rotate counter-clockwise until the third gear 176 engages an outer portion 182B of the sector gear 182 such that the swing arm assembly 170 is in its first end-most position, see FIG. 6. Once the swing arm assembly 170 is located in its first end-most position, the spring 178A allows any further counter-clockwise rotation of the first gear 174 to occur relative to the plates 172A and 172B.

Figure 6A:
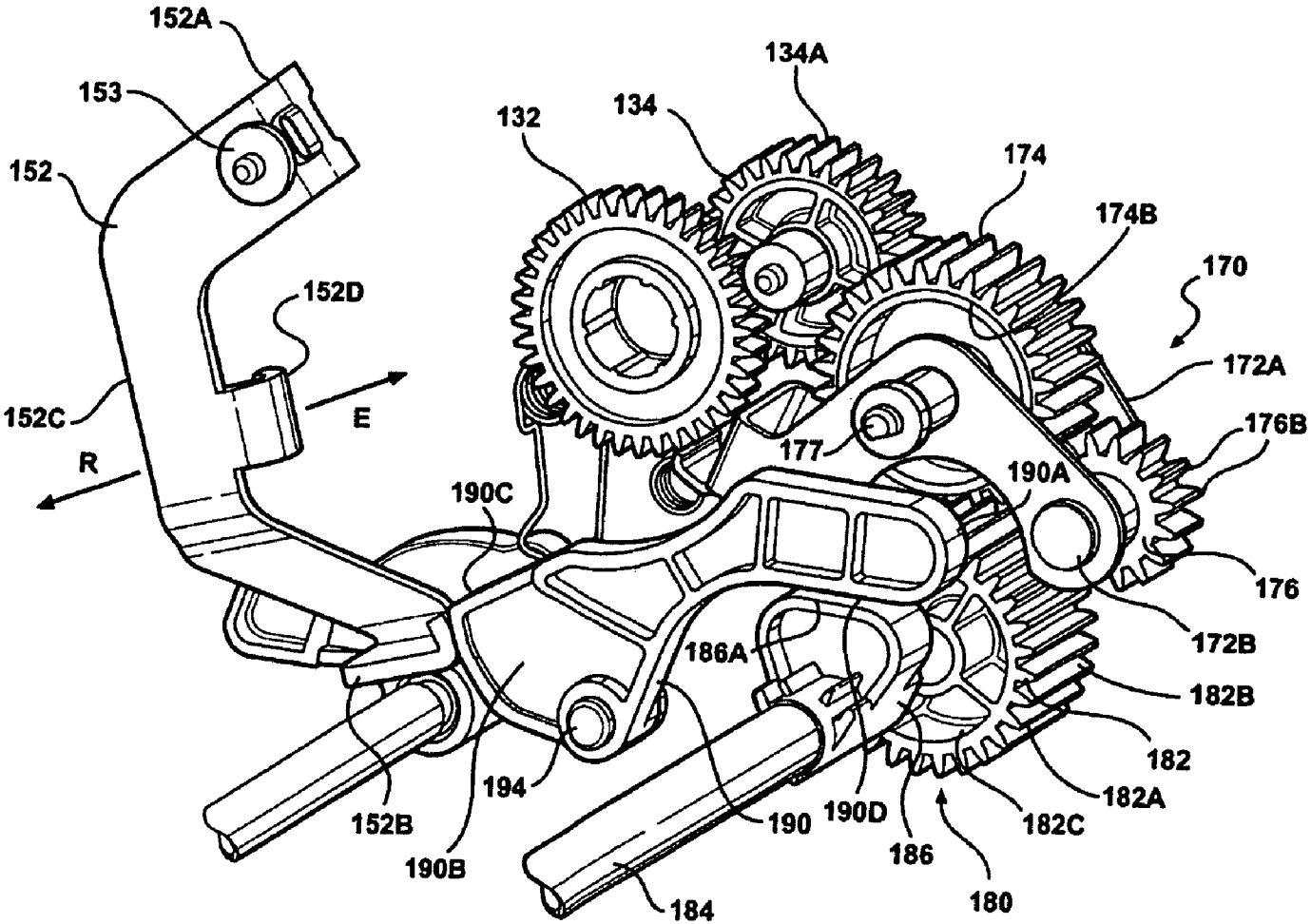
FIG. 6A is a perspective view taken from a different angle than shown in FIG. 4 of the swing arm assembly of the fuser assembly illustrated in FIG. 1.

The cam assembly 180 comprises, in the illustrated embodiment, the sector gear 182, a cam shaft 184, first and second cam elements 186 and 188 and first and second cam levers 190 and 192, see FIGS. 3 and 6A (only first cam lever 190 shown in FIG. 6A). The sector gear 182 comprises a double width gear including the inner portion 182A for engagement with the second gear 175 and the outer portion 182B for engagement with the third gear 176. The inner portion 182A comprises a first inner segment 182C including teeth 183 and a second inner segment 182D devoid of teeth, see FIGS. 3 and 6. The first inner segment 182C defines a first inner arc of about 309 degrees, while the second inner segment 182D defines a second inner arc of about 51 degrees. The size of the first and second inner arcs may vary. The outer portion 182B comprises a first outer segment 182E including teeth 183 and a second outer segment 182F devoid of teeth, see FIGS. 4 and 6. The first outer segment 182E defines a first inner arc of about 309 degrees, while the second outer segment 182F defines a second outer arc of about 51 degrees. The size of the first and second outer arcs may vary.

The sector gear 182, the first cam element 186 and the second cam element 188 are coupled to the cam shaft 184 for rotation with the cam shaft 184. The first and second cam levers 190 and 192 comprise first ends 190A and 192A, for engaging the first and second cam elements 186 and 188, respectively, and second ends 190B and 192B including first and second cam lobes 190C and 192C for engaging the second ends 152B and 154B of the first and second levers 152 and 154, respectively, see FIG. 3. The first and second cam levers 190 and 192 are rotatably mounted on pivot pins 194 and 196, respectively. Rotation of the camshaft 184 counter-clockwise as viewed in FIGS. 3 and 6A causes the first and second cam elements 186 and 188 to engage the first ends 190A and 192A of the first and second cam levers 190 and 192 causing the first and second cam levers 190 and 192 to rotate counter-clockwise about the pivot pins 194 and 196, respectively. As the first and second cam levers 190 and 192 rotate counter-clockwise about the pivot pins 194 and 196, respectively, the first and second cam lobes 190C and 192C engage the second ends 152B and 154B of the first and second levers 152 and 154 causing the first and second levers 152 and 154 to rotate clockwise in FIGS. 3 and 6A and counter-clockwise in FIGS. 4 and 5 about the pivot pins 153 and 155 extending the springs 160 and 162. As the first and second levers 152 and 154 rotate about the pins 153 and 155 clockwise in FIG. 3 and counter-clockwise in FIGS. 4 and 5, the first and second lever extensions 152D and 154D move away from the engagement members 2114B and 2114C of the first and second endcaps 114B and 114C, generally in the direction R, releasing the force applied by the first and second springs 160 and 162 and the first and second lever extensions 152D and 154D to the first and second engagement members 2114B and 2114C, respectively. As a result, the first and second endcaps 114B and 114C move in the slots 104 in the direction R away from the backup roller 125 releasing the pressure applied between the belt 112A and the backup roller 125 at the nip 75, see FIGS. 3, 4, 5 and 6A.

In the first scenario, noted above, when the swing arm assembly 170 is in its first end-most position, as shown in FIG. 7, and the second compound gear 134 rotates counter-clockwise, see FIG. 4, the first gear 174 is caused to rotate clockwise causing the spring 178A to frictionally engage the inner wall 1172A of the second plate 172B and generate a force capable of moving the first and second plates 172A and 172B clockwise. When the nip release structure 199 is oriented as illustrated in FIG. 5, the first and second plates 172A and 172B rotate clockwise until teeth 175B on the second gear 175 mesh with the teeth 183 on the inner portion 182A of the sector gear 182 such that the swing arm assembly 170 is in its second end-most position, see FIG. 8. Rotation of the first gear 174 clockwise, as viewed in FIG. 8, causes the second gear 175 to rotate counter-clockwise. Once the teeth 175B on the second gear 175 engage with the teeth 183 on the inner portion 182A of the sector gear 182, the second gear 175 causes the sector gear 182 to rotate clockwise to the position shown in FIG. 9, such that the teeth 175B on the second gear 175 are no longer in engagement with teeth 183 on the inner portion 182A of the sector gear 182 but, rather, are positioned directly across from the second inner segment 182D of the inner portion 182A of the sector gear 182, which, as noted above, is devoid of teeth. The sector gear 182 is maintained in the position shown in FIG. 9 by flat surfaces 190D and 192D on the first ends 190A and 192A of the first and second cam levers 190 and 192 engaging first flat surfaces 186A and 188A on the first and second cam elements 186 and 188 until the third gear 176 engages and rotates the sector gear 182, see FIGS. 3 and 6A.

As the sector gear 182 is rotated from its position shown in FIG. 8 to the position shown in FIG. 9, the first and second cam elements 186 and 188 engage the first ends 190A and 192A of the first and second cam levers 190 and 192 causing the first and second cam levers 190 and 192 to rotate about the pivot pins 194 and 196 clockwise as viewed in FIGS. 8 and 9 and counter-clockwise as viewed in FIGS. 3 and 6A. The counter-clockwise rotation of the first and second cam levers 190 and 192, as viewed in FIGS. 3 and 6A, causes the first and second cam lobes 190C and 192C to engage the second ends 152B and 154B of the first and second levers 152 and 154 and apply a force generally in the direction of arrow A in FIGS. 8 and 9. The movement of the second ends 152B and 154B causes the levers 152 and 154 to pivot away from the backup roller 125 and extend the first and second springs 160 and 162. As the levers 152 and 154 pivot away from the backup roller 125, the forces applied by the lever extensions 152D and 154D to the endcaps 114B and 114C are reduced. Hence, the force applied by the first fuser structure 110 against the second fuser structure 120 is reduced as well.

After completion of each print job or when a paper jam is being corrected, the nip release structure 199 is caused to be oriented as shown in FIG. 5, as will be discussed more thoroughly below. Further, the processor 12 actuates the drive motor so as to rotate in a direction to effect rotation of the second compound gear 134 counter-clockwise, as viewed in FIG. 7, i.e., the reverse direction, such that the first and second cam elements 186 and 188 are rotated to a position so as to cause the levers 152 and 154 to pivot away from the backup roller 125, as previously described. Thus, the pressure between the first and second fuser structures 110 and 120 in the fuser nip 75 is reduced so as to reduce the likelihood that polymeric or elastomeric layers forming part of the belt 112A and the backup member 122 will be deformed permanently.

In the second scenario, noted above, when the swing arm assembly 170 is in its second end-most position, as shown in FIG. 9, and the second compound gear 134 rotates clockwise, see FIG. 4, the first gear 174 is caused to rotate counter-clockwise causing the spring 178A to frictionally engage the inner wall 1172A of the second plate 172B and generate a force so as to move the first and second plates 172A and 172B counter-clockwise. The first and second plates 172A and 172B rotate counter-clockwise until teeth 176B on the third gear 176 mesh with the teeth 183 on the outer portion 182B of the sector gear 182 such that the swing arm assembly 170 is in its first end-most position, see FIG. 6. Rotation of the first gear 174 counter-clockwise causes the third gear 176 to rotate clockwise. Once the teeth 176B on the third gear 176 mesh with the teeth 183 on the outer portion 182B of the sector gear 182, the third gear 176 causes the sector gear 182 to rotate counter-clockwise to the position shown in FIG. 7, such that the teeth 176B on the third gear 176 are no longer in engagement with the teeth 183 on the outer portion 182B of the sector gear 182, but, rather, are positioned directly across from the second outer segment 182F of the outer portion 182B of the sector gear 182, which, as noted above, is devoid of teeth. The sector gear 182 is maintained in the position shown in FIG. 7 by the flat surfaces 190D and 192D on the first ends 190A and 192A of the first and second cam levers 190 and 192 engaging second flat surfaces 186B and 188B on the first and second cam elements 186 and 188 until the second gear 175 engages and rotates the sector gear 182, see FIGS. 3 and 6A.

As the sector gear 182 is rotated from its position shown in FIG. 6 to the position shown in FIG. 7, the first and second cam elements 186 and 188 are rotated so as to move away from the first ends 190A and 192A of the first and second cam levers 190 and 192 causing the first and second cam levers 190 and 192 to rotate clockwise as viewed in FIG. 3 about the pivot pins 194 and 196. The clockwise rotation of the first and second cam levers 190 and 192 causes the first and second cam lobes 190C and 192C to move away from the second ends 152B and 154B of the first and second levers 152 and 154. In response, the springs 160 and 162 contract causing the extensions 152D and 154D of the first and second levers 152 and 154 to apply forces, generally in the direction of arrow E in FIG. 7. The forces applied by the contracted springs 160 and 162 to the second ends 152B and 154B of the levers 152 and 154 cause the levers 152 and 154 to pivot clockwise in FIGS. 4 and 5 and counter-clockwise in FIG. 3 about the pins 153 and 155 and move toward the backup roller 125. As the levers 152 and 154 move toward the backup roller 125, the extensions 152D and 154D apply increased forces against the engagement members 1114B and 2114B, generally in the direction indicated by the arrow E, onto the endcaps 114B and 114C so as to increase the force applied by the first fuser structure 110 against the second fuser structure 120, see FIGS. 3, 4 and 6A. The spring rates of the springs 160 and 162 are preferably selected such that the forces applied by the extensions 152D and 154D onto the endcaps 114B and 114C are sufficient to achieve a desired nip load, i.e., a desired compressive load within the nip 75.

When the printer 10 is initially turned on or reactivated after a prolonged period of inactivity, the processor 12 actuates the drive motor so as to rotate the first compound gear 132 in a direction to effect rotation of the second compound gear 134 clockwise in FIG. 4, i.e., the forward direction, such that the first and second cam elements 186 and 188 are rotated to a position so as to cause the levers 152 and 154 to pivot toward the backup roller 125 as previously described. Hence, the pressure between the first and second fuser structures 110 and 120 in the fuser nip 75 is increased to a desired nip pressure.

Referring again to FIGS. 4 and 5, the nip release structure 199 comprises a release cam part 200 and a first member 202 positioned between the release cam part 200 and the swing arm assembly 170. The release cam part 200 comprises a release cam 204 mounted on a shaft 206. A rack 208, integral to the release cam 204 is operated by a pinion (not shown) causing the release cam 204 and shaft 206 to rotate. The pinion is driven by a pinion motor (not shown). The release cam 204 further comprises a release cam lobe 210 including an engagement surface 212, see FIG. 5, for engagement with the first member 202 as will be described below. Rotation of the pinion in a first direction causes the release cam 204 to rotate counter-clockwise, as viewed in FIG. 4, to a non-release position such that the release cam lobe 210 engages the first member 202, as seen in FIG. 4. Rotation of the pinion in a second direction causes the release cam 204 to rotate clockwise to a release position such that the release cam lobe 210 moves away from the first member 202 as seen in FIG. 5. The processor 12 controls the pinion motor and causes the pinion to transition between the release position and the non-release position. After a power-on-reset operation, during a functional test or a calibration operation, and when the printer receives a print job, the processor 12 causes the pinion motor to rotate in a first direction to cause rotation of the release cam 204 to the non-release position. When the printer finishes a print operation or when a paper jam is detected, the processor 12 causes the pinion motor to rotate in a second direction to cause rotation of the release cam 204 to the release position.

As illustrated, the first member 202 comprises a bias spring 214, see FIG. 5A, including a first arm 216 for engaging the surface 212 of the release cam lobe 210, a second arm 218 for engaging the tab 172D provided on the intermediate member 172C of the swing arm assembly 170, and a spring element 220 coupling the first arm 216 to the second arm 218. The spring element comprises a spring coil 222 having an axis C passing through the center of the spring coil 222. The bias spring 214 is mounted to a mounting structure (not shown) provided on an inside surface of a cover (not shown) by a fastener (not shown), and is free to rotate about the axis C. In the illustrated embodiment, the cover comprises a molded plastic cover that is coupled to the main frame 102 and to an extension on the shaft 177 passing through the first gear 174 and the first and second mounting plates 172A and 172B by screws (not shown). The bias spring 214 has a center of gravity such that the bias spring 214 will assume a position such that the second arm 218 is not in contact with the tab 172D when the release cam 204 is in the release position, see FIG. 5.

Rotation of the pinion in the first direction causes the release cam 204 to rotate counter-clockwise, as seen in FIG. 5, such that the release cam lobe 210 engages the first arm 216 of the bias spring 214 and applies a force thereto causing the bias spring 214 to rotate clockwise about the axis C to a force applying position, see FIG. 4. As noted above, rotation of the pinion in the first direction occurs after a power-on-reset operation, during a functional test or calibration operation, and when the printer receives a print job. In the force applying position, the bias spring second arm 218 engages the tab 172D provided on the swing arm 170 intermediate member 172C and applies a force to the tab 172D, generally in the direction indicated by the arrow F, see FIG. 4. The force applied to the tab 172D biases the swing arm assembly 170 in a counter-clockwise rotational position as viewed in FIG. 4. The bias spring 214 is configured such that the counter-clockwise biasing force applied to the tab 172D is sufficient to overcome the clockwise rotational force applied by the drag generating member 178 to the first and second mounting plates 172A and 172B when the first gear 174 is caused to rotate clockwise by the drive apparatus 130, as previously described. Thus, the swing arm assembly 170 is prevented from rotation in the clockwise direction to the second end-most position when the release cam 204 is rotated to the non-release position causing the bias spring 214 to rotate to the force applying position. In this manner, the nip engagement and release apparatus 140 is prevented from releasing the nip pressure when the first compound gear 132 is rotated in a clockwise direction and the second compound gear 134 is rotated in a counter-clockwise direction, as seen in FIG. 4, such that the fuser assembly 100 is rotated in a reverse direction by the drive apparatus 130. This allows the fuser assembly 100 to maintain the nip pressure required for fusing while the drive motor reverses rotational direction, such as when performing a duplex operation, and improves the throughput of the machine because it is not necessary to re-pressurize the nip after reversing the drive motor as would otherwise be necessary.

Rotation of the pinion in the second direction to the release position such that the release cam 204 moves away from the first arm 216 of the bias spring 214 allows the bias spring 214 to rotate counter-clockwise to a relaxed position, see FIG. 5. As noted above, rotation of the pinion in the second direction occurs when the printer finishes a print job or when a paper jam is detected. In the relaxed position, the second arm 218 moves away from the tab 172D, allowing the swing arm 170 to rotate in the clockwise direction, as seen in FIG. 4, in response to the clockwise rotational force produced by the drag generating member 178 when the first gear 174 is caused to rotate in the clockwise direction, as viewed in FIG. 4, by the drive apparatus 130 releasing the nip pressure, as previously described. In this manner, the nip pressure may be released by causing the release cam 204 to rotate to the release position as shown in FIG. 5 and causing the second compound gear 134 to rotate in a counter-clockwise direction, as viewed in FIG. 4, as previously described.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fuser assembly comprising:

first fuser structure comprising a heated rotatable member and first support structure for supporting said heated rotatable member;

second fuser structure comprising a rotatable backup member positioned adjacent said heated rotatable member and second support structure for supporting said backup member, said rotatable backup member adapted to define a nip with said heated rotatable member;

drive apparatus associated with one of said heated rotatable member and said backup member for effecting rotation of said one member in a selected first direction or a second direction; and nip engagement and release apparatus comprising:

nip-loading structure;

at least one spring for engaging said nip-loading structure;

a swing arm assembly; and nip release structure, said swing arm assembly being adapted to pivot to a first position in response to said one member rotating in said first direction and to a second position in response to said one member rotating in said second direction and said nip release structure being positioned in a relaxed state, said nip-loading structure being adapted to apply a sufficient force to one of said first and second support structures to achieve a desired nip load in response to said one member rotating in said first direction and decreasing said force to said one support structure to decrease the load at said nip in response to said one member rotating in said second direction and said nip release structure being positioned in a relaxed state.

2. A fuser assembly as set out in claim 1, wherein said first fuser structure further comprises a heater element, and said first support structure comprises a bracket supporting said heater element and first and second endcaps for supporting said bracket, and said heated rotatable member comprises an endless belt positioned about said heater element and said bracket and is supported by said bracket and said endcaps.

3. A fuser assembly as set out in claim 1, wherein said backup member comprises a backup roll and said second support structure comprises a pair of bearings mounted within a frame for supporting said backup roll.

4. A fuser assembly as set out in claim 3, wherein said drive apparatus comprises a motor and a gear train, said gear train including a gear coupled to said backup roll.

5. A fuser assembly as set out in claim 1, wherein said nip engagement and release apparatus further comprises a cam assembly including at least one cam element for positioning said nip-loading structure to apply said sufficient force to said one support structure in response to said one member rotating in said first direction and for positioning said nip-loading structure to decrease the force applied to said one support structure in response to said one member rotating in said second direction and said nip release structure being positioned in said relaxed state.

6. A fuser assembly as set out in claim 5, wherein said swing arm assembly comprises:

first and second spaced-apart mounting plates coupled to one another;

a first gear mounted between said first and second mounting plates adapted to engage with a gear forming part of said drive apparatus, said swing arm assembly pivoting about an axis of said first gear;

a drag generating member provided between said first plate and said first gear, said drag generating member transferring a force via friction from said first gear to said first mounting plate in response to rotation of said first gear, said force causing said first and second plates to pivot in response to movement of said first gear; and second and third gears mounted between said mounting plates and in engagement with said first gear for rotation with said first gear.

7. A fuser assembly as set out in claim 6, wherein said cam assembly comprises:

a sector gear comprising a first segment including teeth and a second segment devoid of teeth;

a cam shaft coupled to said sector gear for rotation with said sector gear; and a first cam element coupled to said cam shaft for rotation with said cam shaft, wherein said third gear causing said sector gear to rotate to effect movement of said cam shaft to cause said first cam element to position said nip-loading structure to apply said sufficient force to said one support structure and said second gear causing said sector gear to rotate to cause said first cam element to position said nip-loading structure to decrease the force applied to said one support structure.

8. A fuser assembly as set out in claim 7, wherein said cam assembly further comprises a second cam element.

9. A fuser assembly as set out in claim 6, wherein said drag generating member comprises a spring.

10. A fuser assembly as set out in claim 1, wherein said nip release structure comprises a first member capable of being positioned in a relaxed positioned and a force applying position.

11. A fuser assembly as set out in claim 10, where said nip release structure further comprises a cam part capable of engaging said first member so as to move the first member to either its relaxed position or its force applying position.

12. A fuser assembly as set out in claim 11, wherein said first member comprises a spring.

13. A fuser assembly comprising:

a first fuser structure comprising a heated rotatable member and a first support structure for supporting said heated rotatable member;

a second fuser structure comprising a rotatable backup member positioned adjacent said heated rotatable member and a second support structure for supporting said backup member, said rotatable backup member defining a nip with said heated rotatable member;

a drive apparatus associated with one of said heated rotatable member and said backup member for effecting rotation of said one member; and a nip engagement and release apparatus comprising:

a nip-loading structure;

at least one first bias member for engaging said nip-loading structure; and a nip release structure, said nip-loading structure applying a sufficient force to one of said first and second support structures to achieve a desired nip load in response to said one member rotating in a first direction and decreasing said force to said one support structure to decrease the load at said nip in response to said one member rotating in a second direction and said nip release structure being positioned in a first state.

14. The fuser assembly of claim 13, further comprising a swing arm assembly moving to a first position in response to said one member rotating in a first direction and to a second position in response to said one member rotating in a second direction and said nip release structure being positioned in the first state.

15. The fuser assembly as set out in claim 14, wherein said swing arm assembly comprises:

first and second spaced-apart mounting plates coupled to one another;

a first gear mounted between said first and second mounting plates for engaging with a gear forming part of said drive apparatus, said swing arm assembly pivoting about an axis of said first gear;

a drag generating member provided between said first plate and said first gear, said drag generating member transferring a force via friction from said first gear to said first mounting plate in response to rotation of said first gear, said force causing said first and second plates to pivot in response to movement of said first gear; and one or more second gears mounted between said mounting plates and in engagement with said first gear for rotation with said first gear.

16. The fuser assembly as set out in claim 15, wherein said cam assembly comprises:

a sector gear comprising a first segment including teeth and a second segment devoid of teeth;

a cam shaft coupled to said sector gear for rotation with said sector gear; and a first cam element coupled to said cam shaft for rotation with said cam shaft, wherein one of said second gears causing said sector gear to rotate to effect movement of said cam shaft to cause said first cam element to position said nip-loading structure to apply said sufficient force to said one support structure and another of said second gears causing said sector gear to rotate to cause said first cam element to position said nip-loading structure to decrease the force applied to said one support structure.

17. The fuser assembly as set out in claim 14, wherein said cam assembly comprises:

a sector gear comprising a first segment including teeth and a second segment devoid of teeth;

a cam shaft coupled to said sector gear for rotation with said sector gear; and a first cam element coupled to said cam shaft for rotation with said cam shaft, wherein said swing arm assembly causes said sector gear to rotate to effect movement of said cam shaft to cause said first cam element to position said nip-loading structure to apply said sufficient force to said one support structure and causes said sector gear to rotate to cause said first cam element to position said nip-loading structure to decrease the force applied to said one support structure.

18. The fuser assembly as set out in claim 13, wherein said nip engagement and release apparatus further comprises a cam assembly including at least one cam element for positioning said nip-loading structure to apply said sufficient force to said one support structure in response to said one member rotating in said first direction and for positioning said nip-loading structure to decrease the force applied to said one support structure in response to said one member rotating in said second direction and said nip release structure being positioned in said first state.

19. The fuser assembly as set out in claim 18, wherein said cam assembly further comprises a second cam element.

20. The fuser assembly as set out in claim 13, wherein said nip release structure comprises a second bias member positionable in said first state and a force applying state, and a cam part engaging said second bias member so as to move said second bias member between the first state and the force applying state.

* * * * *